US005282406A

United States Patent [19]

Ng

[11] Patent Number: 5,282,406

[45] Date of Patent: Feb. 1, 1994

[54] SLICING MACHINE

[76] Inventor: Shiu S. Ng, 21 Eldridge St. Apt. 8, New York, N.Y. 10002

[21] Appl. No.: 26,492

[22] Filed: Mar. 4, 1993

Related U.S. Application Data

[63] Continuation-in-part of Ser. No. 826,093, Jan. 27, 1992, abandoned.

[51] Int. Cl.[5] ..... B26D 1/12; B26D 7/06

[52] U.S. Cl. ..... 83/167; 83/355; 83/417; 83/468.7; 83/596; 83/663; 83/932

[58] Field of Search ..... 83/167, 355, 356, 417, 83/437, 467.1, 468.7, 591, 595, 596, 663, 665, 666, 673, 676, 703, 932; 241/92; 99/537, 538

[56] References Cited

U.S. PATENT DOCUMENTS

| | | | |
|---|---|---|---|
| 1,155,965 | 10/1915 | Smith | 83/468.7 |
| 1,199,389 | 9/1916 | Kopacki | 83/437 |
| 2,479,712 | 8/1949 | Baalberger | 83/703 X |
| 2,590,909 | 4/1952 | Westby et al. | 83/437 X |
| 3,972,256 | 8/1976 | Ross | 83/356 X |
| 4,283,979 | 8/1981 | Rakocy et al. | 83/591 X |
| 4,448,100 | 5/1984 | Breeden | 83/355 |
| 4,516,733 | 5/1985 | Funagura et al. | 83/355 X |
| 4,913,019 | 4/1990 | Hayashi | 83/355 X |

*Primary Examiner*—Eugenia Jones

[57] ABSTRACT

A slicing machine includes a blade-plate assembly and a stationary support structure capable of slicing multiple as well as varied food products at the same time. The blade-plate assembly includes a spiraled outer edge support plate and a circular blade having a spiraled inside cutting edge detachably mounted to the support plate. The slicing machine is particularly adept at high speed, hands free slicing of food product.

4 Claims, 4 Drawing Sheets

SLICING MACHINE

This is a continuation-in-part of application Ser. No. 07/826,093 filed Jan. 27, 1992 now abandoned.

BACKGROUND OF THE INVENTION

This invention relates to slicing machines with a circular blade used for slicing food products such as meats and vegetables with particular emphasis on high speed, hands free slicing applications.

Slicing machines of various designs with numerous cutting blade configurations are being used to prepare food products for cooking and/or serving. They all have been designed specifically to slice either meats or vegetables but not both efficiently. Some of these machines requires the assistance of an operator to help with the slicing action. Most of them are capable of slicing only one food product at a time thus limiting the machine's productivity. In many cases, the particular way in which a slicing machine slices into the food product can affect the cooking, handling and storage of the sliced food product.

Because of the diversity in shape, size and density of the many different food products, it would seem that more than one of these slicing machines will be required at any given time in order to meet the various slicing needs as they present them selves.

SUMMARY OF THE INVENTION

The ideal slicing blade for all food products is a knife. By holding it at a shallow incline to the table, meats and vegetables can be sliced easily by dragging the knife across them. The shallow angle allows for a long gradual cut so that no ripping or tearing occurs.

The blade design of this invention is modeled after this cutting action. It basically is a planar circular plate with a spiraled edge cutout in its center. The entire length of this spiraled inside edge is the cutting edge of the blade. A support plate, whose outer edge is shaped identically to the inside spiraled edge cutout of the blade, is variably mounted planarly parallel below the blade to control the slicing thickness. The blade-plate assembly is detachably mounted onto a support structure which provides support and rotational motion. A retaining structure is then attached onto the support structure with its bottom just slightly above the blade-plate assembly. This retaining structure consists of two concentric cylindrical walls with four radial walls between them at 90°. The inner and outer circular walls have radii corresponding respectively to the ending and beginning points of the spiral cutting edge. The four chambers formed by this retaining structure are used to hold the food products in place while the blade-plate assembly is slicing them. Depending on the position of the blade-plate assembly, food product placed into the chambers may rest on top of the blade or fall down between the spiraled cutting edge and the inner circular wall onto the support plate. When the machine is actuated, the circular blade rotates in the counterclockwise direction. Food products resting on top of the support plate are pushed against the various abutments formed by the inner cylindrical wall and the radial walls of the retaining structure by the spiraled cutting edge. Once held by the abutments, the spiraled cutting edge begins to slice into any material that rests on the support plate. Any material that rests on top of the circular blade will slide along on top of the blade until the linear portion of the blade's inside edge passes under it. At this point, the food product falls down onto the support plate because an opening is created by the transition from the end of the spiraled cutting edge to the beginning of the spiraled cutting edge which is furthest away from the inner circular wall. The support plate being shaped similar to the spiraled cutting edge, offers less and less support to the sliced material as the spiraled cutting edge slices deeper and deeper. When the sliced material is finally severed by the end of the spiraled cutting edge, it falls freely away because there is no support from the support plate. At this point the linear portion of the circular blade's inside edge will pass under the unsliced food product allowing it to fall down onto the support plate and the slicing process starts all over again. Thus it can be seen that this machine offers hands free operation. Because of the blade's shallow cutting angle, many advantages can be realized. Food product may be sliced in all four chambers at the same time without the machine binding up which makes for high speed slicing. Different food products may be sliced at the same time without any special adjustments. The long cutting edge combined with the shallow cutting angle produces an ideal slicing action similar to that of a carving knife.

Thus it can be seen that the present invention has over come all the deficiencies that are commonly found with all slicing machines.

DETAILED DESCRIPTION OF THE DRAWINGS

Figure 1:
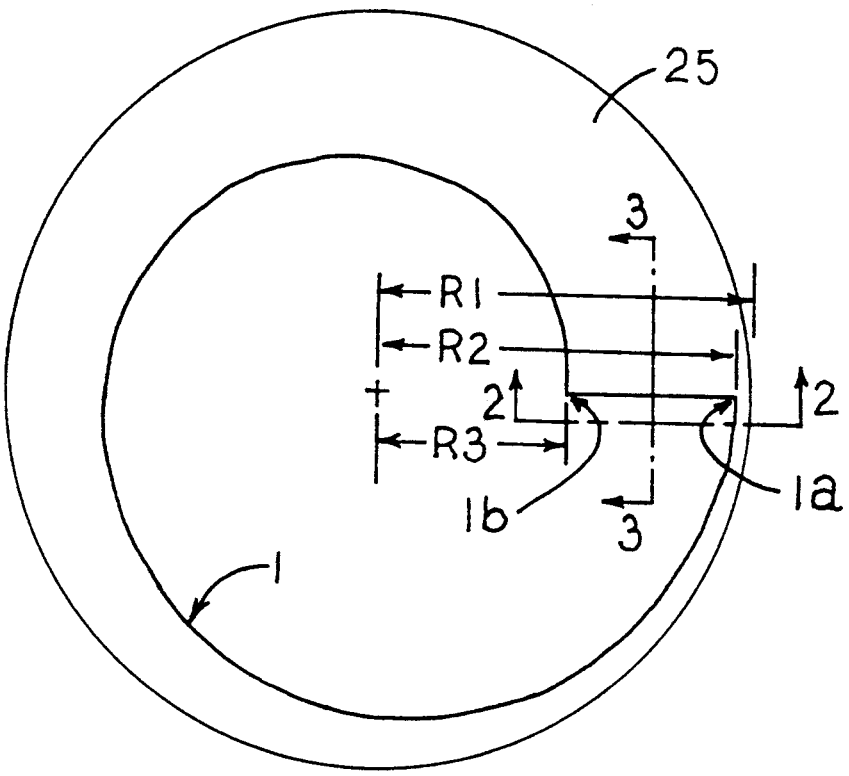
FIG. 1 Top view of an embodiment of a circular blade with its spiraled inside cutting edge.
Figure 2:
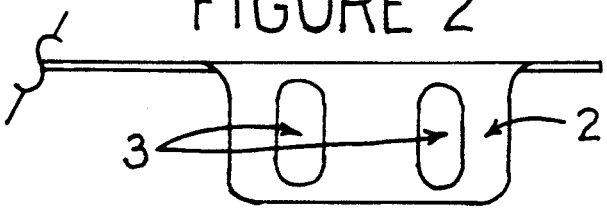
FIG. 2 Front elevation sectional view of circular blade's mounting flap (enlarged).
Figure 3:
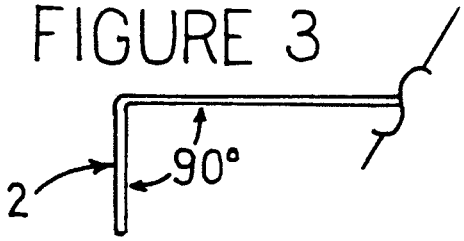
FIG. 3 Right side elevation sectional view of the circular blade's mounting flap (enlarged).

FIG. 1 shows a preferred embodiment of a circular blade 25 of radius R1 with its inside spiraled cutting edge 1 starting at 1*a* with a radius of R2 and ending at 1*b* with a radius of R3. To maintain the shallow cutting angle, R3 should not be less than one half R1. The linear edge in the radial direction between 1*a* and 1*b* is made by folding the mounting flap 2 downwards 90° as can be seen from FIG. 2 and FIG. 3. On the flap are two slotted openings 3 which allow the two mounting screws 5 and wing nuts 8 to detachably mount the support plate 2*b* planarly parallel at variable depths to the circular blade thus forming the blade-plate assembly.

The slicing action of this blade 25 is achieved by rotating it in the couterclockwise direction. This rotation causes the spiraled inside cutting edge 1 to slice deeper and deeper into any food product in its path. Food product resting on top of the blade will slide along until the linear edge between 1*a* and 1*b* passes under it. At this point, the food product will drop down onto the support plate and be sliced.

Figure 4:
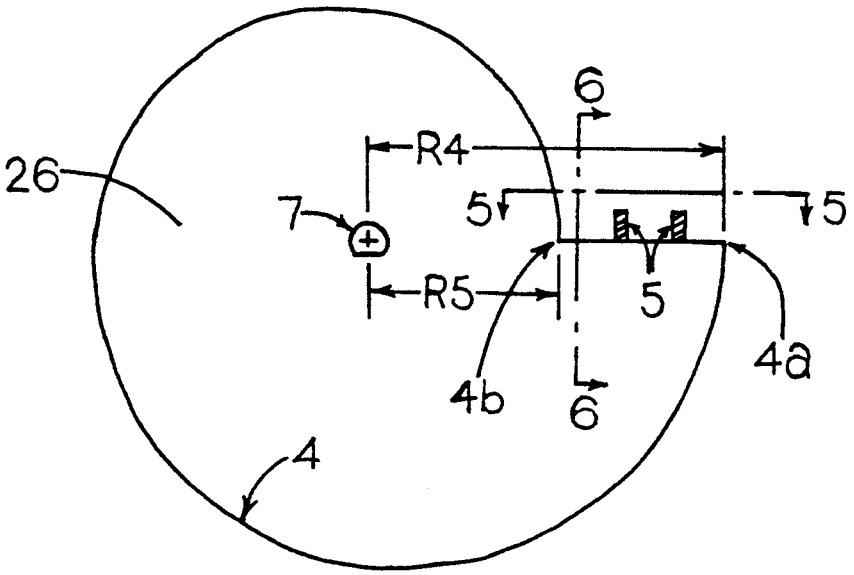
FIG. 4 Top view of an embodiment of a spiraled support plate with its spiraled outer edge.
Figure 5:
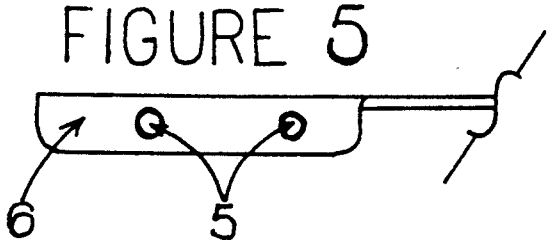
FIG. 5 Back elevation sectional view of the support plate's mounting flap (enlarged).
Figure 6:
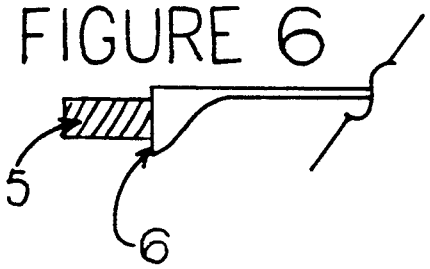
FIG. 6 Left side elevation sectional view of the support plate's mounting flap (enlarged).

FIG. 4 show a preferred embodiment of the support plate 2*b* with its spiraled outer edge 4 starting at 4*a* and ending at 4*b*. This spiral outer edge 4 is identical to the spiraled inside cutting edge 1. This is necessary for the sliced food products to fall freely from the blade-plate assembly. Food product resting on support plate 26, before cutting edge 1 has started to slice into it, is fully supported by the support plate. This is necessary so that cutting edge 1 slices into the food product at a predetermined height above the support plate 26. This height is the desired thickness of the slice. As the spiraled cutting edge 1 cuts deeper and deeper into the food product, the support plate's spiraled outer edge 4 follows it inward giving less and less support to the sliced food product. At the end of the cutting edge 1*b* where the sliced portion is completely severed, there is no more support from the support plate and the sliced food portion falls freely out of the blade-plate assembly. The linear edge in the radial direction between 4*a* and 4*b* is made by folding the mounting flap 6 downwards 90° as can be seen from FIG. 5 and FIG. 6. On this mounting flap 6 are two screws 5 which in conjunction with wing nuts 8, are used to detachably mount to the circular blade's mounting flap 2 to form the blade-plate assembly. A mounting hole 7 at the center of the support plate 26 is used to detachably mount the blade-plate assembly onto the shaft 9 of the drive motor 10.

Figure 7:
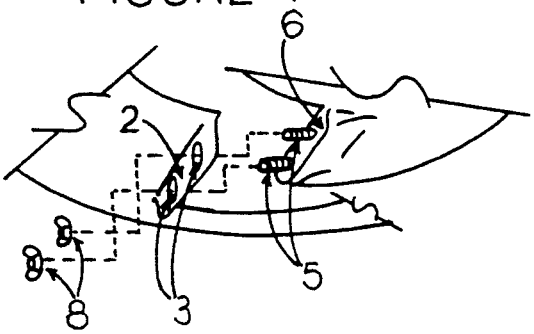
FIG. 7 Exploded view of the interconnection between the circular blade and the support plate.

FIG. 7 is a preferred embodiment of a mounting method between circular blade 25 and support plate 26, Screws 5 of mounting flap 6 can be attached anywhere along vertical slots 3 of mounting flap 2. This adjusts the vertical space between circular blade 25 and support plate 26 thus controlling the slicing thickness. Once the slicing thickness is decided on, screws 5 are locked into positions along slot 3 by the wing nuts 8.

Figure 8:
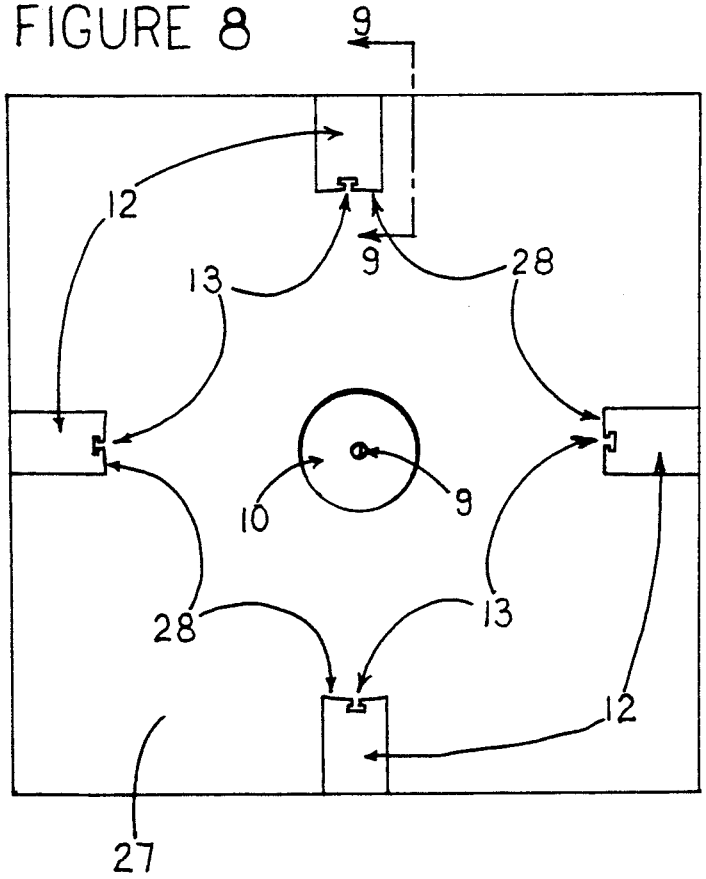
FIG. 8 Top view of the support structure and drive motor.

FIG. 8 shows a preferred embodiment of a stationary support structure consisting of square base 27, motor 10 and four vertical support columns 12. The four support columns 12 are mounted rigidly onto base 27 at the middle of each of the four sides. The inside surface 28 of support columns 12 are a distance R2 from the center of base 27. At this center base 27 is rigidly mounted motor 10 with its shaft 9 presented vertically upwards for imparting rotational motion onto the blade-plate assembly.

Figure 9:
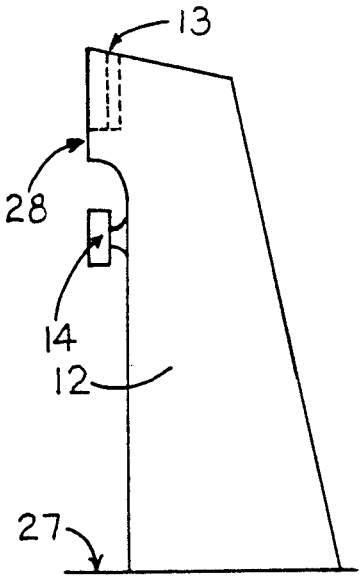
FIG. 9 Front elevation sectional view of the vertical support column.

FIG. 9 shows a preferred embodiment of a support structure support column 12 with its retaining structure attachment slot 13 and blade support bearing 14. The positions of blade support bearings are such that they are in contact with only the rim of the circular blade between R1 and R2 on FIG. 1. Groove 13 is cut into the inside surface 28 of each of the four supports columns 12. This is used to detachably mount corresponding lugs 19 from the retaining structure's outer cylindrical wall. These lugs 19 slid down grooves 13 and rest inside support columns 12 such that when mounting lugs 19 are firmly seated in grooves 13, the bottom edges of the retaining structure are just above the circular blade 25.

Figure 10:
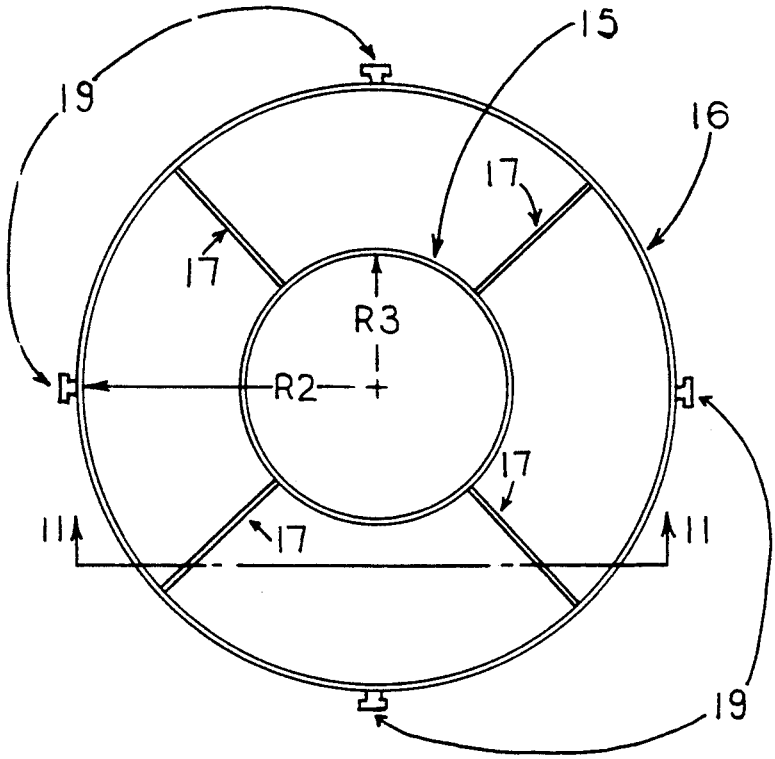
FIG. 10 Top view of the retaining structure.

FIG. 10 shows the preferred embodiment of a retaining structure. Its inner cylindrical wall 15 with radius of R3 and outer cylindrical wall 16 with radius of R2 are concentric about the center of base plate 27. These cylindrical walls are used to limit and confine food product for slicing to the radial width of spiraled cutting edge 1. Four radial walls 17 rigidly mounts outer cylindrical wall 16 to inner cylindrical wall 15 at evenly paced intervals of 90°. Chambers 18 formed by them are used to hold food products stationary as the rotating spiraled cutting edge 1 slices into them. It can be seen from FIG. 11 that the bottom edges of cylindrical walls 15 and 16 and radial walls 17 are all leveled to each other. This allows the retaining structure to be placed planarly parallel and just above circular blade 25 without interfering with its rotational movement. Since the slicing action of spiraled cutting edge 1 is directed mainly inwards towards the center, inner cylindrical wall 15 is made taller than the other walls to prevent food products from tipping over into the middle. On the outside of outer cylinder wall 16 are the mounting lugs 19 which are used to detachably mount this retainign structure to support structure support columns 12.

Figure 11:
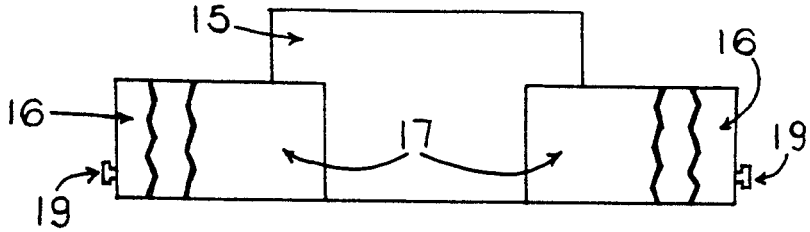
FIG. 11 Front elevation sectional view of the retaining structure.
Figure 12:
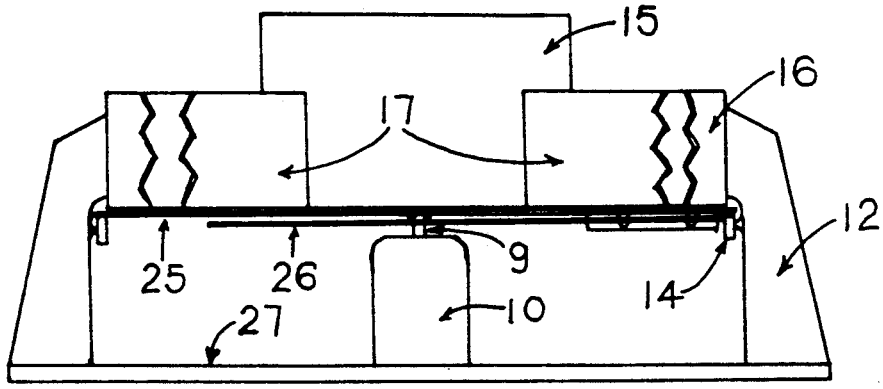
FIG. 12 Front elevation sectional view of the assembled slicing machine.

FIG. 12 shows the slicing machine fully assembled with the same sectional view of the retaining structure as in FIG. 11.

What is claimed is:

1. A slicing machine comprising a stationary support structure having a horizontally disposed base plate, a motor having a drive shaft affixed vertically at the center of said base plate, vertical support columns mounted onto said base plate, a blade-plate assembly having a spiraled outer edge support plate detachably mounted onto said drive shaft, a circular blade with a spiraled inside cutting edge detachably mounted to said support plate, and a retaining structure having a cylindrical outer wall detachably mounted onto said support columns, a cylindrical inner wall concentric with said outer wall, and four straight walls extending in the radial direction between said outer and inner walls and spaced 90° apart from each other.

2. A slicing machine as set forth in claim 1 wherein:

said spiraled inside cutting edge has a beginning point near a circular outer edge of said blade said spiraled edge winding inwards to an ending point at about half of said blade's radius as it spans one revolution around the inside of the blade the entire length of said spiraled edge being sharpened, a mounting blade flap extending linearly int he radial direction connecting said beginning point to said ending point of said spiraled inside cutting edge.

3. A slicing machine as set forth in claim 2 wherein:

said spiraled outer edge of said support plate is identical in shape and size to said spiraled inside cutting edge of said blade, a support plate mounting flap extending linearly in the radial direction connects a beginning point to an ending point of said spiraled outer edge, a mounting hole formed in the center of said support plate for detachably mounting said support plate onto said drive shaft.

4. A slicing machine as set forth in claim 2 wherein:

said cylindrical inner and outer walls of said retaining structure have radii respectively equal to the radii of said ending and beginning points of said spiraled inside cutting edge of said circular blade.

* * * * *